US006042046A

United States Patent [19]

Beyer, Sr.

[11] Patent Number: 6,042,046

[45] Date of Patent: Mar. 28, 2000

[54] REELING AND UNREELING APPARATUS, SYSTEM AND METHOD

[76] Inventor: Anthony W. Beyer, Sr., 1605 Purple Martin Dr., Springdale, Ark. 72764

[21] Appl. No.: 08/915,513

[22] Filed: Aug. 13, 1997

[51] Int. Cl.[7] ..... B65H 19/00; B65H 75/44; B65H 75/40

[52] U.S. Cl. ..... 242/559.1; 242/399.2; 242/399.1; 242/557; 242/403

[58] Field of Search ..... 242/399.1, 399.2, 242/559.1, 592, 557, 403, 570; 414/911

[56] References Cited

U.S. PATENT DOCUMENTS

| | | | |
|---|---|---|---|
| 527,879 | 10/1894 | Potter | 242/559.1 |
| 2,839,257 | 6/1958 | Chicane | 242/86.5 |
| 2,914,270 | 11/1959 | Parker et al. | 242/86.5 |
| 2,942,797 | 6/1960 | Lorenz et al. | 242/559.1 |
| 3,045,936 | 7/1962 | Ruggeri | 242/54 |
| 3,048,348 | 8/1962 | Griffin | 242/54 |
| 3,394,903 | 7/1968 | Rom | 242/399.1 |
| 3,934,655 | 1/1976 | Whistle . | |
| 4,084,707 | 4/1978 | McFarland | 242/559.1 |
| 4,095,706 | 6/1978 | Schwien et al. | 414/911 |
| 4,179,034 | 12/1979 | Van Antwerp et al. | 414/911 |
| 4,437,622 | 3/1984 | Heider . | |
| 4,775,114 | 10/1988 | Farnsworth . | |
| 4,925,435 | 5/1990 | Linklater . | |
| 4,930,718 | 6/1990 | Lancour et al. . | |
| 5,163,634 | 11/1992 | Moon et al. . | |
| 5,388,782 | 2/1995 | King . | |

*Primary Examiner*—John Q. Nguyen
*Attorney, Agent, or Firm*—Head, Johnson & Kachigian

[57] ABSTRACT

A device for unreeling and/or reeling spools of material. The device has a horizontal frame assembly formed of a drawbar and a cantilever frame wherein the drawbar is for connection to a vehicle; a vertical frame that is affixed to the horizontal frame and for connection to a vehicle; a rotatable shaft pivotally attached to the horizontal frame, dimensioned for receiving a spool of material thereover, and having a base for supporting the spool of material near the pivot end; and a winch or cylinder for lowering the shaft from an upright to a horizontal position and for selectively raising the shaft.

29 Claims, 8 Drawing Sheets

REELING AND UNREELING APPARATUS, SYSTEM AND METHOD

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

1. Field of the Invention

The present invention relates to roll stock winding and unwinding as well as wire fence erecting implements. More particularly, the invention relates to an attachment for affixing to a vehicle to facilitate the reeling and unreeling of fencing, barbed wire or related materials.

2. Background

Devices for attachment onto vehicles to assist in reeling and unreeling wire and fencing materials are known. Examples of such devices can be found in U.S. Pat. No. 2,914,270 to Parker et al. for a "Vehicle Attached Wire Stretching and Reeling Device"; U.S. Pat. No. 3,048,348 to Griffin for a "Wire Fencing Stringing and Stretching Implement"; U.S. Pat. No. 3,934,655 to Whistle for a "Hydraulic Post Setting and Wire Dispensing Apparatus"; U.S. Pat. No. 2,839,257 to Chicane for a "Wire Reel"; U.S. Pat. No. 4,775,114 to Farnsworth for a "Fencing Wire Unwinder and Tensioner"; U.S. Pat. No. 4,925,435 to Linklater for an "Apparatus for Winding and Unwinding Wire"; U.S. Pat. No. 4,930,718 to Lancour et al. for a "Fencing Dispenser"; U.S. Pat. No. 5,163,634 to Moon et al. for a "Fence Stretching Apparatus"; and U.S. Pat. No. 5,388,782 to King for an "Apparatus for Winding Fence Material".

The above-mentioned Chicane, Farnsworth, and Whistle patents describe attachments which are capable of unwinding one or more reels of wire. However, these devices are not designed to deliver woven wire fencing materials.

The inventions described in the above mentioned patents to Parker et al., Griffin, Lancour et al., Moon et al. and King are designed to unroll reels of woven wire fencing material. However, King does not allow the fencing material to be unreeled from a vertical orientation; therefore, the fencing material has to be lifted in a separate step to utilize it for fencing purposes. The King, Parker et al., Lancour et al. and Moon et al. devices do not allow for the unreeling of individual strands of wire such as would be necessary in the construction of a barbed wire fence. The Griffin device does provide for the addition of a single spool of barbed wire to be unreeled simultaneously with the reel of fencing material.

Of the patents discussed above, only the Parker et al. and Lancour et al. patents describe attachments which allow for the tilting of the apparatus necessary for ease of loading the device with a reel of fencing material. The Parker et al. device provides a means for lowering a spindle for insertion through the center of a reel of fencing material. However, the Parker et al. device requires that the lift arms of a three-point hitch of a tractor be used to raise and lower the spindle. Additionally, for the Parker et al. device to raise a loaded reel of wire, the user must utilize the lift arms and move the tractor forward to physically force the device to pivot upwardly.

The Lancour et al. patent describes a fencing dispenser wherein a reel of fencing material is placed within a cage-like structure. The cage is lowered by means of a hydraulic cylinder. The hydraulic cylinder is used to pivot the cage in a plane perpendicular to the tractor. The reel of fencing material can then be rolled into the cage. The Lancour et al. device does not have a spindle to support the fencing reel but instead allows the reel to move freely within the cage.

Hence, there is a need for a reeling and unreeling device which allows the apparatus to be connected to either a three-point hitch of a tractor or a drop hitch of the type typically found on a pickup truck. Additionally, there is a need for a device which allows the unreeling of either a reel of fencing material, a plurality of barbed wire strands, or any combination of various widths of fencing material together with barbed wire strands. Finally, there is a need for a device which possesses means for lowering the reeling rod or spindle to increase the ease of loading the device while mounted on a stationary vehicle.

BRIEF SUMMARY OF THE INVENTION

In accordance with the present invention, a device, apparatus, system and method is provided which addresses the drawbacks of prior devices and provides for reeling and/or unreeling for laying out fencing and/or for winding and retrieving fence materials including either single strands of wire or reels of woven fencing material of various heights.

Also, the present invention provides a device upon which it is easy to load heavy reels of fencing material by providing a means for raising, lowering and articulating a reeling rod or spindle without having to move the tractor or vehicle during the loading process.

In accordance with an exemplary embodiment of the present invention there is provided a device for reeling and unreeling spools of material. The device includes a horizontal frame assembly having a drawbar and a cantilever or extending frame wherein the preferred embodiment, the drawbar is adapted to be connected to two points of a three-point hitch of a tractor. The device includes a vertical frame assembly fixed to the horizontal frame assembly and providing an upper connection point adapted for connection to the third point of a three-point hitch. A reeling shaft or spindle is pivotally attached to the horizontal frame thereby enabling the reeling shaft or spindle to be tilted for receiving reels of fencing material. The device also includes a lowering means to facilitate the raising and lowering of the reeling shaft or spindle.

The principal object of the present invention is the provision of a fencing unreeling apparatus, device, system, and method which is easy to use, relatively simple in construction, relatively inexpensive to manufacture, easy to install, and facilitates the laying out of barbed wire, woven fencing, and/or other fencing materials.

Another object of the present invention is the provision of a fencing reeling and unreeling device, system, apparatus, and method for unwinding and laying out of fences as well as for winding and retrieving fence materials.

A still further object of the present invention is the provision of a reeling and unreeling apparatus, device, system, and method adapted for use with multiple rolls of fencing materials.

A more particular object of the present invention is the provision of a reeling rod or spindle which provides for the placement of a plurality of vertically spaced rolls of barbed wire or other strand-type fencing material.

Yet another more particular object of the present invention is the provision of a reeling rod or spindle which provides for the reeling and unreeling of a combination of barbed wire or stranded fencing materials along with woven or other fencing materials.

Still yet another object of the present invention is the provision of a reeling and unreeling device, apparatus, system, and method adapted for placement on the bumper or in the bed of a pickup truck.

Other objects and further scope of the applicability of the present invention will become apparent from the detailed description to follow, taken in conjunction with the accompanying drawings wherein like parts are designated by like reference numerals.

DETAILED DESCRIPTION OF THE INVENTION

Figures 1, 2, 3, 4, 5, 6:
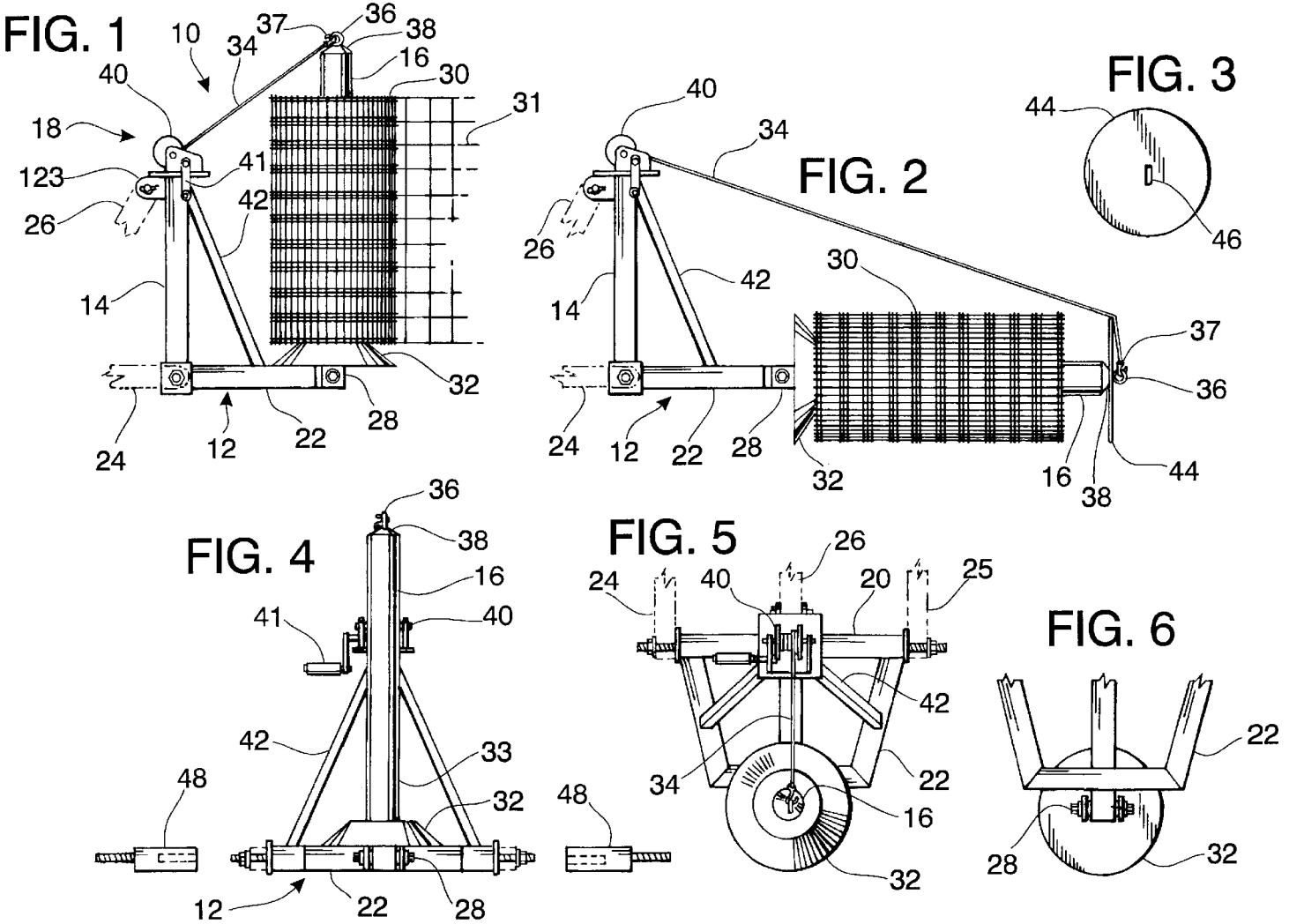
FIG. 1 is a side elevational view illustrating an exemplary embodiment of the device of the present invention mounted to a three-point hitch and with the rotatable shaft in its upright position.
FIG. 2 is a side elevational view of the device of FIG. 1 with the shaft in a lowered position.
FIG. 3 is a top view of the spacer disk of FIG. 2.
FIG. 4 is a rear elevational view of the device of FIG. 1.
FIG. 5 is a top view of the device of FIG. 1.
FIG. 6 is a bottom view of the device of FIG. 1.

Referring initially to FIGS. 1–6 of the drawings, an exemplary embodiment of a fencing unreeling device is designated generally by the numeral 10 and includes a horizontal frame assembly 12, a vertical frame assembly 14 having a bracket 123, an unreeling rotatable shaft 16, and an angular lowering or articulating winch 18. Horizontal frame assembly 12 includes a drawbar 20 and an extending or cantilever frame 22. Shown with phantom lines in FIGS. 1, 2, 4 and 5 are lower arms 24 and 25 and upper arm 26 which make up a three-point hitch typically found on a tractor.

The unreeling shaft 16 is pivotally affixed to the end of frame 22 at a pivot point 28. Loaded onto unreeling shaft 16 is a spool 30 of fencing material 31. Spool 30 rests upon a base 32 affixed to the lower end of shaft 16 just above the pivot point 28. Shaft 16 is held upright by a cable 34, which is releasably affixed to attachment point 36 by a hook 37. In a preferred embodiment, attachment point 36 is a loop affixed to shaft 16 at terminal end 38. Cable 34 is used to raise or lower reeling shaft 16 by means of winch 18. In a preferred embodiment, winch 18 is a conventional winch having a cable spool 40 and a manually operated handle 41. In FIG. 1, shaft 16 is shown in the upright operative unreeling position. Reinforcing members 42 connect the horizontal and vertical frame assemblies.

FIG. 2 depicts a side elevational view of the device 10 wherein shaft 16 is shown in a lowered reel loading or unloading position. Cable 34 is shown affixed to attachment point 36. However, to prevent cable 34 from impinging on spool 30, a spacer plate 44 is affixed proximate terminal end 38 of shaft 16.

FIG. 3 is a top view of spacer plate 44 having orifice 46 formed therethrough to receive loop 36.

Referring now to FIG. 4, a rear elevational view of device 10 is shown with spool 30 removed for the sake of clarity. An exploded view of device 10 shows drawbar extensions 48 which may be secured to the threaded studs on the ends of drawbar 20 to accommodate different spacings of lower arms 24 and 25 that may be encountered with different size vehicles and tractor models.

FIG. 5 is a top view cf the device 10 with spool 30 removed and showing drawbar 20 affixed to frame 22.

FIG. 6 is a bottom view of the device 10 showing pivot point 28 and base 32.

In practicing a preferred embodiment, the unreeling device 10 is preferably affixed to the lower arms 24 and 25 and connecting arm 26 of a three-point hitch on a tractor. Shaft 16 is lowered via cable 34 by means of winch 18 (FIG. 2). Cable 34 is removed from attachment point 36 and spool 30 is then placed on shaft 16. Spacer plate 44 may be positioned on terminal end 38 of shaft 16 prior to reattachment of cable 34 to prevent cable 34 from impinging upon spool 30. Winch 18 is then used to take in cable 34 and raise shaft 16 to an upright position (FIG. 1). The vehicle and device 10 may then be positioned at a fencing location.

The end of fencing material 31 on spool 30 is then affixed to a fencepost or other securing means and the vehicle is moved down a row of fenceposts where spool 30 is unreeled by having both base 32 and shaft 16 or just shaft 16 rotate along with spool 30 as fencing 31 is being unwound by its attachment on the fencepost.

Figure 7:
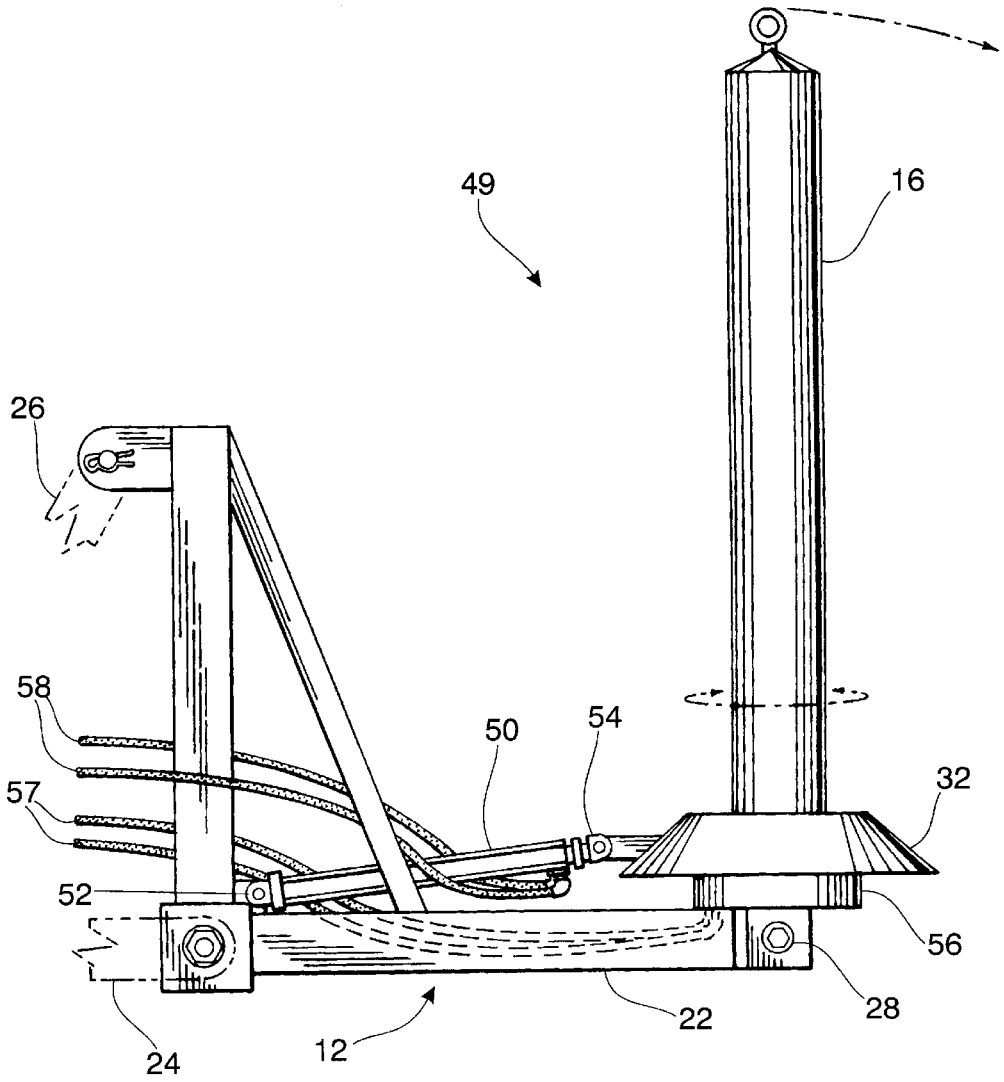
FIG. 7 is a side elevational view representation of another embodiment of the device of the present invention having a hydraulically lifting means and a hydraulicly powered rotating means.

FIG. 7 is a side elevational view of an alternative device 49 having a hydraulic cylinder lifting arrangement 50 and hydraulic shaft rotating motor 56. Hydraulic cylinder 50 is used to raise and lower reeling and unreeling shaft 16. In a preferred embodiment, hydraulic cylinder 50 is pivotally affixed at first end 52 to a point proximate drawbar 20 and is pivotally affixed at second end 54 to a point proximate base 32. Hydraulically driven motor 56 is used to rotate shaft 16 clockwise or counter-clockwise. Hydraulically powered motor 56 receives hydraulic fluid through hydraulic lines 57 and cylinder 50 receives hydraulic fluid through lines 58. Preferably, the hydraulic controls for the hydraulic cylinder 50 and motor 56 are located up near the driver or machinery operator so that they can easily control the raising and lowering of the shaft 16 and the clockwise or counter-clockwise rotation of the shaft 16 for reeling or unreeling fencing material, barbed wire, wire, or the like. In operation, the operator lowers the device 49 toward the ground by lowering arms 24 and 25, articulates the shaft 16 downwardly to a horizontal position by extending hydraulic cylinder 50, places, for example, a roll of fencing material on the ground with the center of the roll located coaxially with the longitudinal axis of the shaft, backs up the vehicle to drive the shaft into the roll of material, raises the entire device including the loaded roll or spool of fencing material slightly by raising arms 24, and then picks the reeling shaft and spool or roll up to the vertical position by retracting hydraulic cylinder 50. When it is time to pay out or roll up fencing material, barbed wire, wire, or the like, one simply controls the flow of hydraulic fluid to the hydraulic motor to rotate the shaft 16 clockwise or counter-clockwise as desired.

Figure 8:
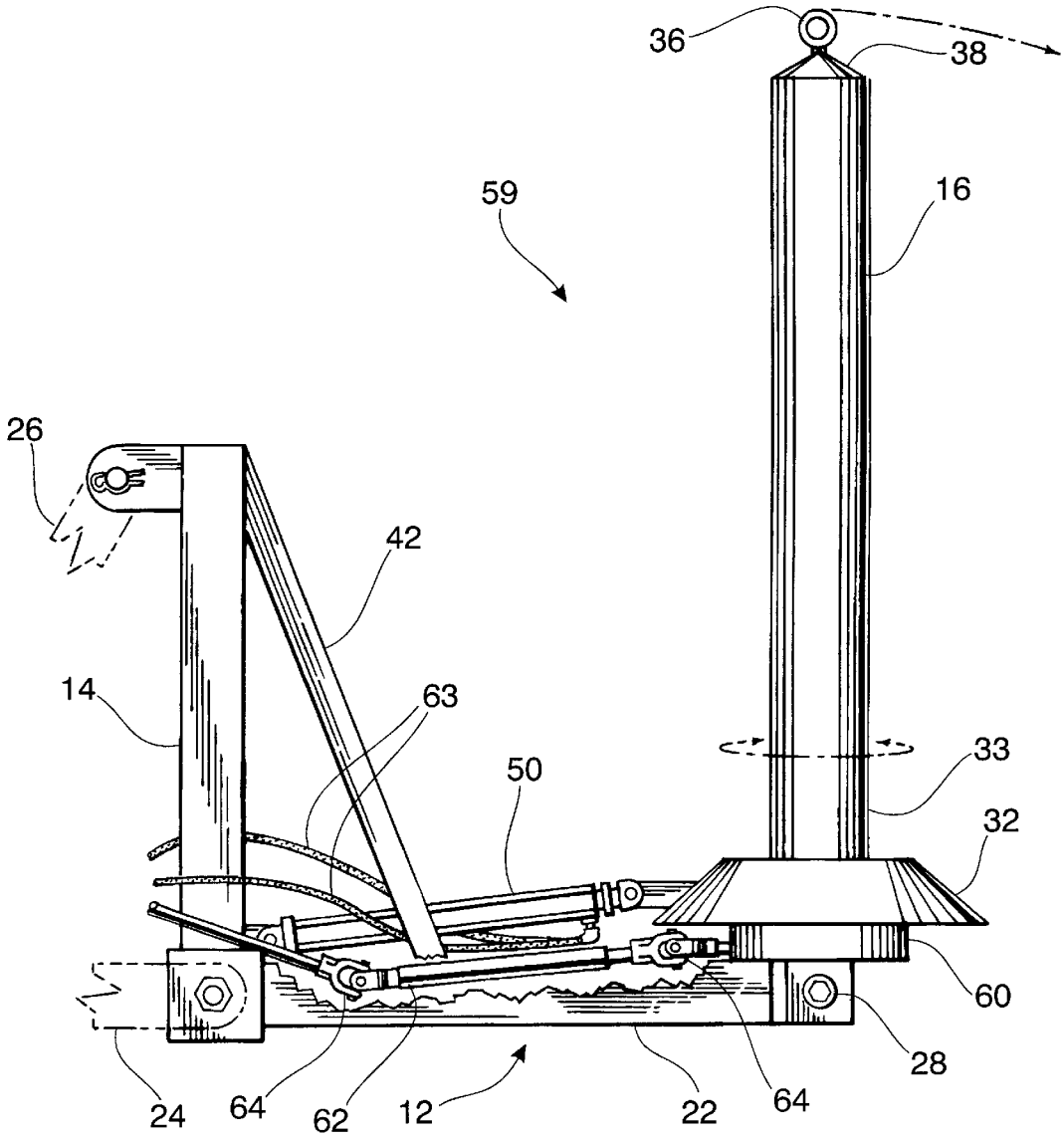
FIG. 8 is a side elevational view illustration of another embodiment of the device having a hydraulic lifting means and rotating means driven by a power take-off shaft.

In accordance with another embodiment, reeling and unreeling shaft 16 of a device 59 is rotationally driven by rotating means or gearbox 60, which receives power from power take-off ("PTO") shaft 62 as shown in FIG. 8. FIG. 8 is a side elevational view showing hydraulic lifting and lowering means 50 for raising and lowering shaft 16. The shaft 62 is driven by the power take-off of a tractor or other vehicle. Hydraulic lifting means 50 receives hydraulic fluid through hydraulic lines 63. PTO shaft 62 is provided with universal joints 64 to facilitate the transfer of rotational power. The device 59 is operated in the same fashion as the device 49 except that the rotation of the reeling and unreeling shaft 16 is controlled by the power take-off of the tractor or other vehicle.

Figure 13:
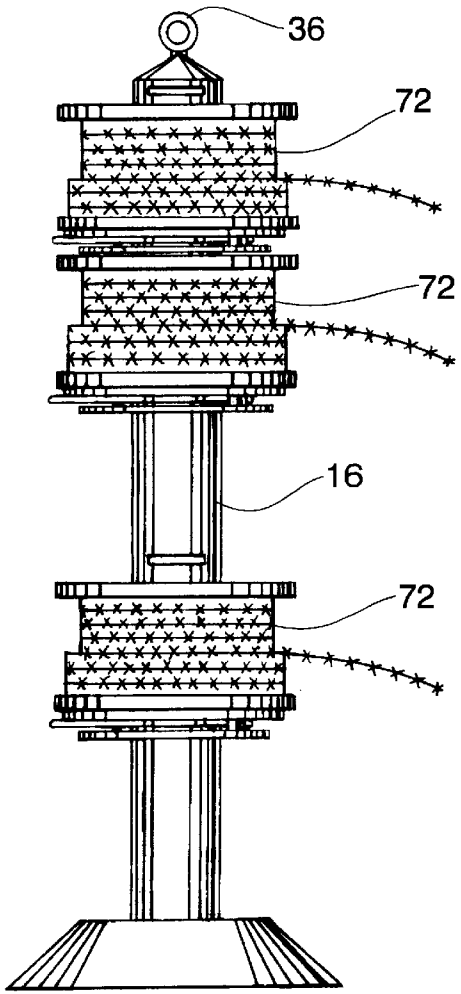
FIG. 13 is a side elevational view of the shaft of FIG. 9 loaded with various spools of material wherein the spools are resting on retainer plates.
Figure 10:
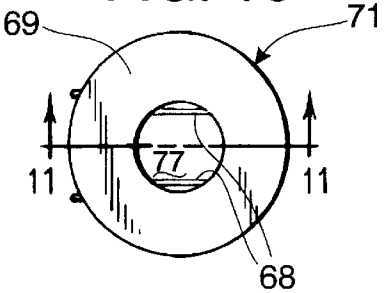
FIG. 10 is a top view of a retainer plate unit for use with the shaft of FIG. 10.
Figure 11:
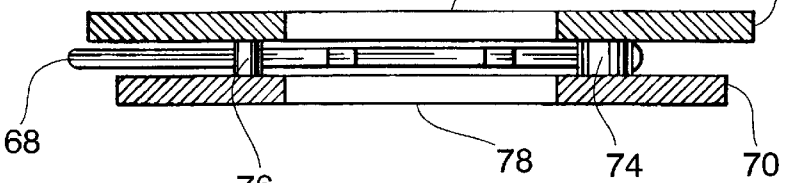
FIG. 11 is a side cross section illustration of the plate unit of FIG. 10 taken along ) line 11—11.
Figure 12:
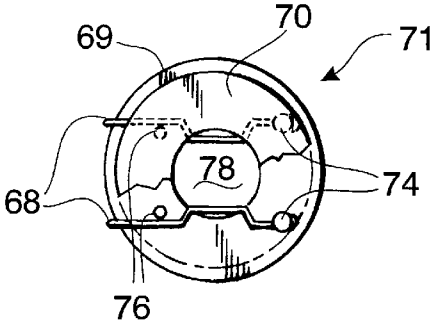
FIG. 12 is a bottom view of the retainer plate of FIG. 10.
Figure 9:
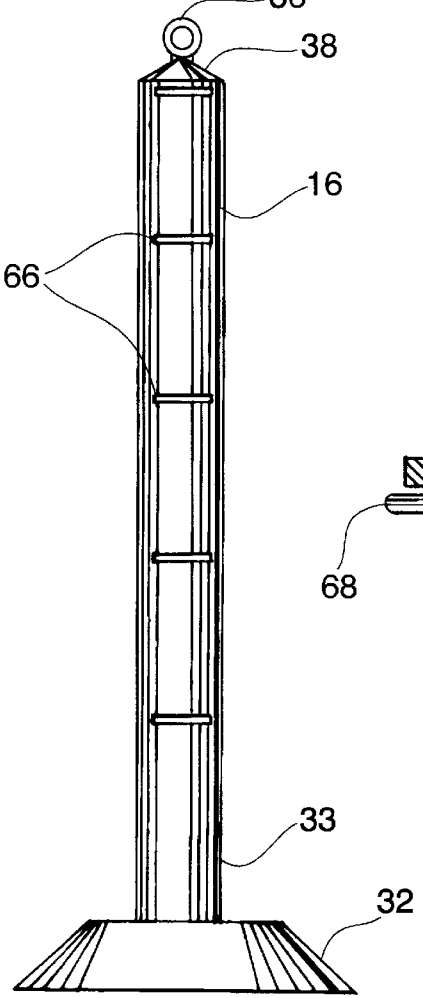
FIG. 9 is a side elevational view representation of another embodiment of the reeling and/or unreeling shaft having slots formed thereon.

Reeling and/or unreeling shaft 16 may be provided with side slots 66 for receiving retainer clips 68, as shown in FIGS. 9–13. Retainer clips 68 are preferably positioned between an upper plate or ring 69 and a lower plate or ring 70 of retainer plate 71, as shown in FIGS. 10–12. One or more retainer plates 71 or spacers may be affixed to the shaft 16, thereby providing a support for one or more spools or rolls 72 of wire, as shown in FIG. 13. By utilizing retainer plates 71, any combination of spools 72 of various widths may be simultaneously affixed tc shaft 16, thereby permitting reels of fencing material and individual barbed wire strands or numerous barbed wire strands or other types of wire to be reeled or unreeled at the same time. If desired, plate 44 (FIG. 3) can be added to the top of shaft 16 and fixed in position by placing, for example, a bolt through loop 36 and releasably attaching the bolt thereto with a nut. Alternatively, a retainer plate 71 may be added at the top of shaft 16 to prevent the upper spool from bouncing or popping off the shaft. Typically, one or two strands of barbed wire are placed above a roll or spool of fencing and payed out or off of shaft 16 simultaneously to install a fence and barbed wire at the same time.

In operation, one can add fencing or wire to the shaft by, for example, lowering the shaft 16 to a horizontal position, adding the fencing or spools of wire thereon, adding a retaining plate 71 by pulling, the protruding ends of the retainer clips 68 apart until the retainer plate is in position with respect to the selected grooves 66 and then allowing the spring force of the retainer clips 68 to force the retainer clips 68 into the selected grooves 66. Although only one side of the shaft 16 is shown, it is to be understood that the grooves 66 are in respective spaced pairs with a groove on each side of the shaft 16 in position to receive each of the pair of retaining clips 68 of a retaining plate 71. When all of the reels, spools and retaining plates have been loaded on the shaft 16, the shaft is raised to its vertical position as shown in FIG. 13.

To use shaft 16 as a reeling device, one may have to insert bolts, set screws, pins, or the like through an empty spool or reel into an opening in the shaft 16 to force the reel to rotate with the shaft 16 and Thereby wind up fencing or wire thereon. Alternatively, one may slide a wedge or other item down between the center of the spool or reel and the shaft 16 and thereby cause a friction fit which will force the spool or reel to rotate with the shaft. When reeling up fencing material of the type shown, for example in FIGS. 1 and 2 of the drawings, usually the friction of the fencing on the shaft once it is overlapping itself will cause the fencing to automatically wind thereon. Further, when reeling or removing used fencing which is to be discarded, one may merely get the fencing, wire or barbed wire wrapped around the shaft 16 one or more times and thereby provide for a friction type attachment of the wire to the shaft so that the attachment of a reel or spool is not necessary. When the fencing, is wound up on the shaft and the vehicle and device are moved to the desired location, one removes the material by simply lowering the shaft to its horizontal position and sliding the material off the shaft and into a disposal receptacle, onto a trailer, or the like.

FIGS. 10, 11 and 12 depict top, side and bottom views, respectively, of the preferred retainer plate 71. In the preferred embodiment, the retainer clips 68 are secured between upper plate 69 and lower plate 70 of retainer plate 71 by means of a securing pins 74 and biasing pins 76. Retainer clips 68 are oriented to be biased toward one another and to extend within the area of orifice 77 in upper plate 69 and orifice 78 in lower plate 70. Therefore, when shaft 16 is slidably received in orifices 77 and 78, retainer clips 68 are pushed outwardly to accommodate the shaft 16. When retainer plate 71 is vertically positioned to align with selected slots 66, retainer clips 68 will spring into slots 66, thereby securing the retainer plate 71 at a desired vertical position.

Figure 16:
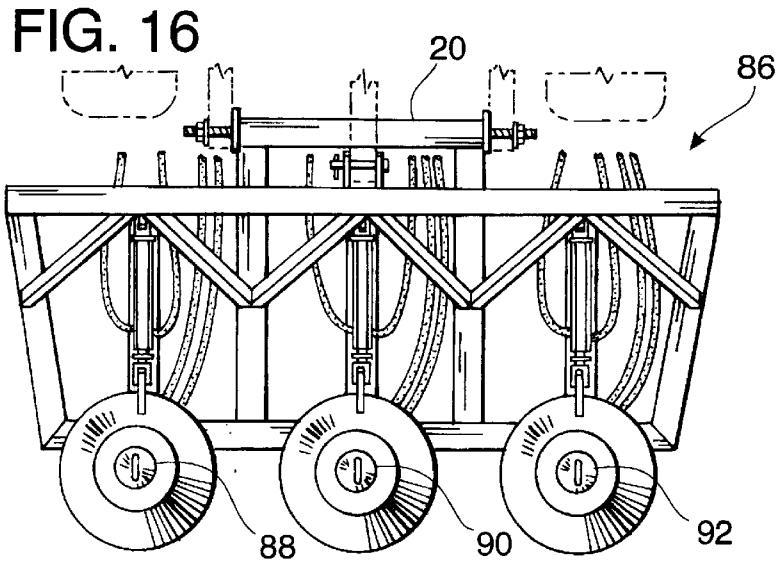
FIG. 16 is a top view representation of a three spool embodiment of the device having three reeling shafts.
Figure 17:
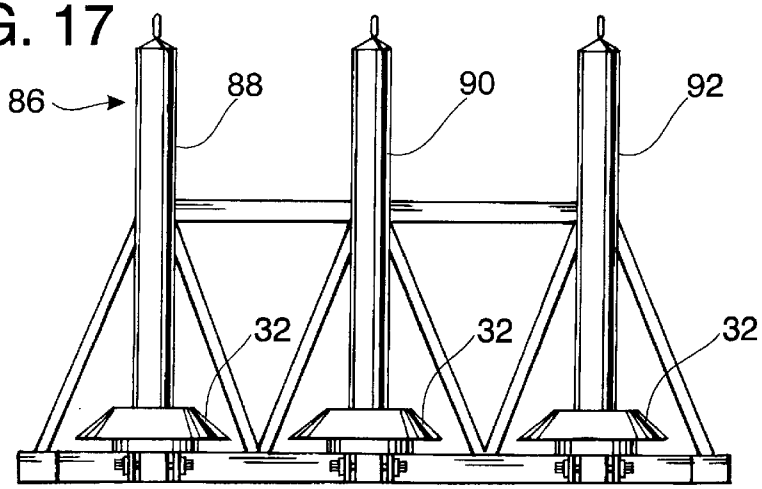
FIG. 17 is a rear elevational view of the device of FIG. 16.
Figure 14:
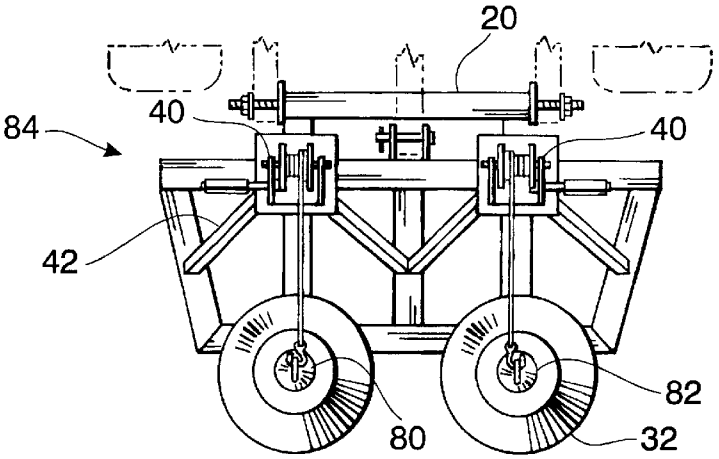
FIG. 14 is a top view illustration of a dual spool embodiment of the device having a pair of spaced shafts.
Figure 15:
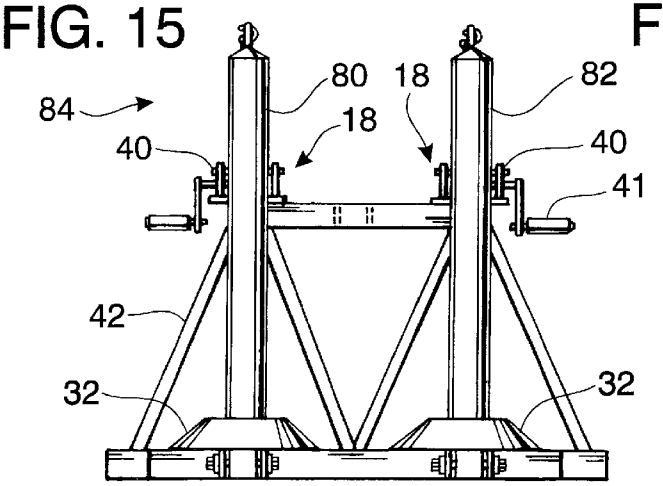
FIG. 15 is a rear elevational view of the device of FIG. 14.

As shown in FIGS. 14–17 and in accordance with the present invention, more than one reeling and/or unreeling shaft may be provided on a device as required. For example, a first unreeling shaft 80 and a second unreeling shaft 82 are affixed on a tandem unreeling device, designated generally 84 (FIGS. 14 and 15). FIGS. 16 and 17 illustrate a three-reeling and unreeling shaft device 86 shown with a left shaft 88, a middle shaft 90 and a right shaft 92.

Certain applications may require reeling and/or unreeling shaft having a larger effective outer diameter 94 (FIGS.

Figure 19:
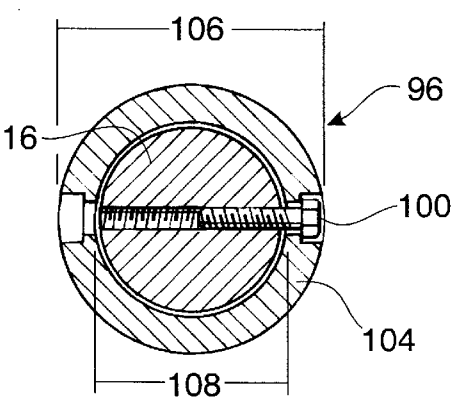
FIG. 19 is a top cross-sectional view with one sleeve taken along line 19—19 in FIG. 18.
Figure 20:
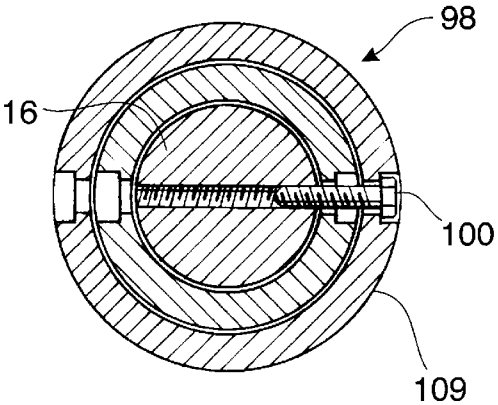
FIG. 20 is a top cross-sectional view with a pair of spacer sleeves taken along line 20—20 in FIG. 18.
Figure 18:
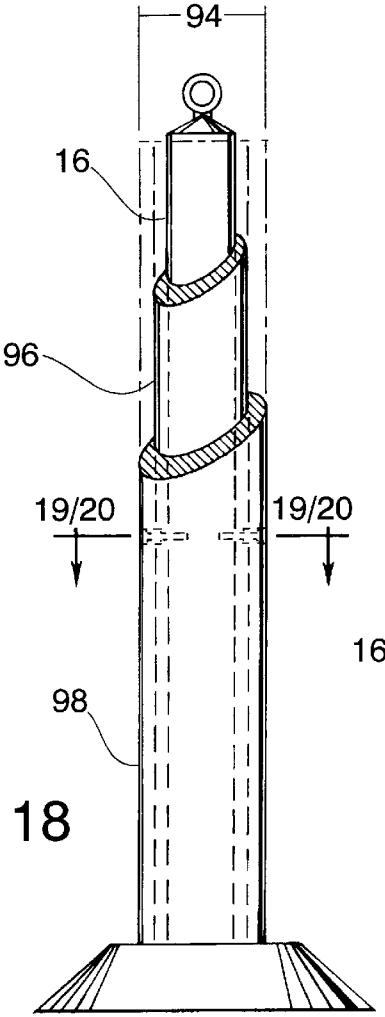
FIG. 18 is a side elevational view of another embodiment of a reeling and/or unreeling shaft having a cut-away view of two sleeves affixed thereto.

18–20). To facilitate increasing the effective diameter 94, a first or inner sleeve 96 may be positioned over shaft 16. Multiple sleeves, such as inner sleeve 96 and an outer sleeve 98 may both be positioned on shaft 16. FIG. 18 is a side elevational view of the shaft 16 having a cut-away view of the two sleeves 96 and 98 affixed thereto. Sleeve 96 may be provided with securing means 100, such as a bolt as shown in FIG. 19. Bolt 100 passes through an opening in wall 104 of sleeve 96 and into a threaded opening in shaft 16. Outer diameter 106 of sleeve 96 is the effective outer diameter of reeling shaft 16 when sleeve 96 is in place. Preferably, inner diameter 108 of sleeve 96 is not substantially larger than the outer diameter of shaft 16. With reference to FIG. 20 of the drawings, sic eves 96 and 98 are attached to shaft 16 by bolt or set screw 100 which passes through an opening in wall 109 of sleeve 98 and through a corresponding opening in wall 104 of sleeve 96 and into a threaded opening in shaft 16. If, however, the shaft 16 and sleeves 96 and 98 are merely being used for unreeling (not reeling) wherein shaft 16 rotates passively in response to fencing being pulled therefrom, it may not be necessary to bolt the sleeves 96 and 98 onto the shaft 16. Also, it is contemplated that other means of releasably attaching the sleeves 96 and 98 to the shaft 16, include but are not limited to pins, cotter keys, shaft keys, wedges, and the like.

In accordance with the present invention, the outer diameter of reeling and/or unreeling shaft 16 is preferably in the range of four to eight inches. In accordance with a particular example, the outer diameter of shaft 16 is four inches, the outer diameter of sleeve 96 is six inches, and the outer diameter of sleeve 98 is eight inches. Depending on the particular type and brand ol roll stock, spool, reel, fencing, wire, barbed wire, or the like being utilized, the outer diameter of a reeling or unreeling shaft 16 in accordance with the present invention may range from one to ten or more inches. Further, it is preferred to form the reeling shaft and sleeves of a sturdy rigid material such as steel, stainless steel, aluminum, or the like. Still further, it is preferred to form the frame components of the devices 10, 49, 59, 71, 84, and 86 of a sturdy rigid material such as box steel, stainless steel, aluminum, or the like.

Figure 21:
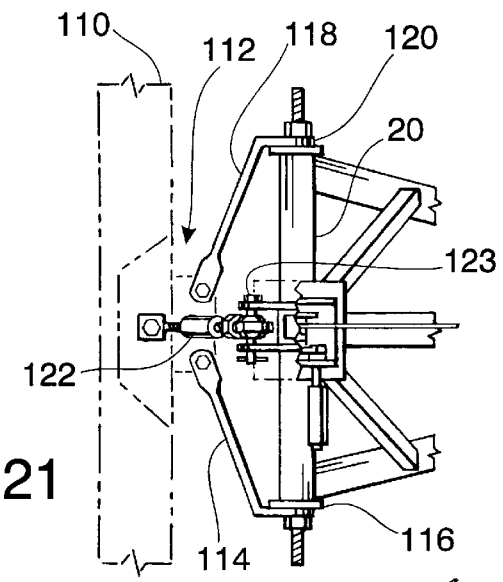
FIG. 21 is a top view cf the unreeling device of FIG. 1 shown affixed to a dropdown hitch.
Figure 22:
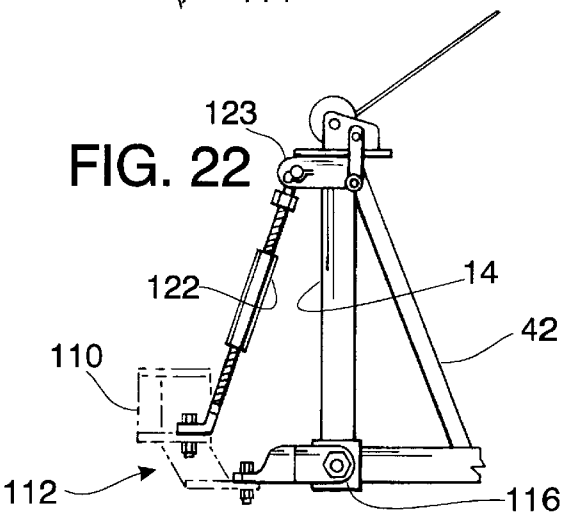
FIG. 22 is a side elevational view of the device shown in FIG. 21.

As shown in FIGS. 21, 22, 24 and 25, device 10 may be adapted for use with a drop-hitch plate of the type typically found on a pickup truck. Shown in FIG. 21 in phantom lines is a pickup truck bumper 110 equipped with a drop-hitch plate 112. FIG. 21 is a top view and FIG. 22 is a side view of the unreeling device 10 of FIGS. 1–6 shown affixed to drop-down hitch plate 112. Horizontal connectors 114 and 118 extend between the ends of drawbar 20 and drop-hitch plate 112 on either side of drawbar 20. Horizontal connector 114 is attached to a first end 116 of drawbar 20. Horizontal connector 118 is connected to second end 120 of drawbar 20. A vertical connector 122 is affixed to a bracket 123 extending from vertical frame 14 and to truck bumper 110. Utilizing horizontal connectors 114 and 118 and vertical connector 122, the unreeling device 10 may be utilized with dropdown hitch plate 112 instead of attachment to a three-point hitch typically used with a tractor. Likewise, reeling and unreeling devices 49, 59, or the like may be attached to a drop-down hitch plate.

Figure 23:
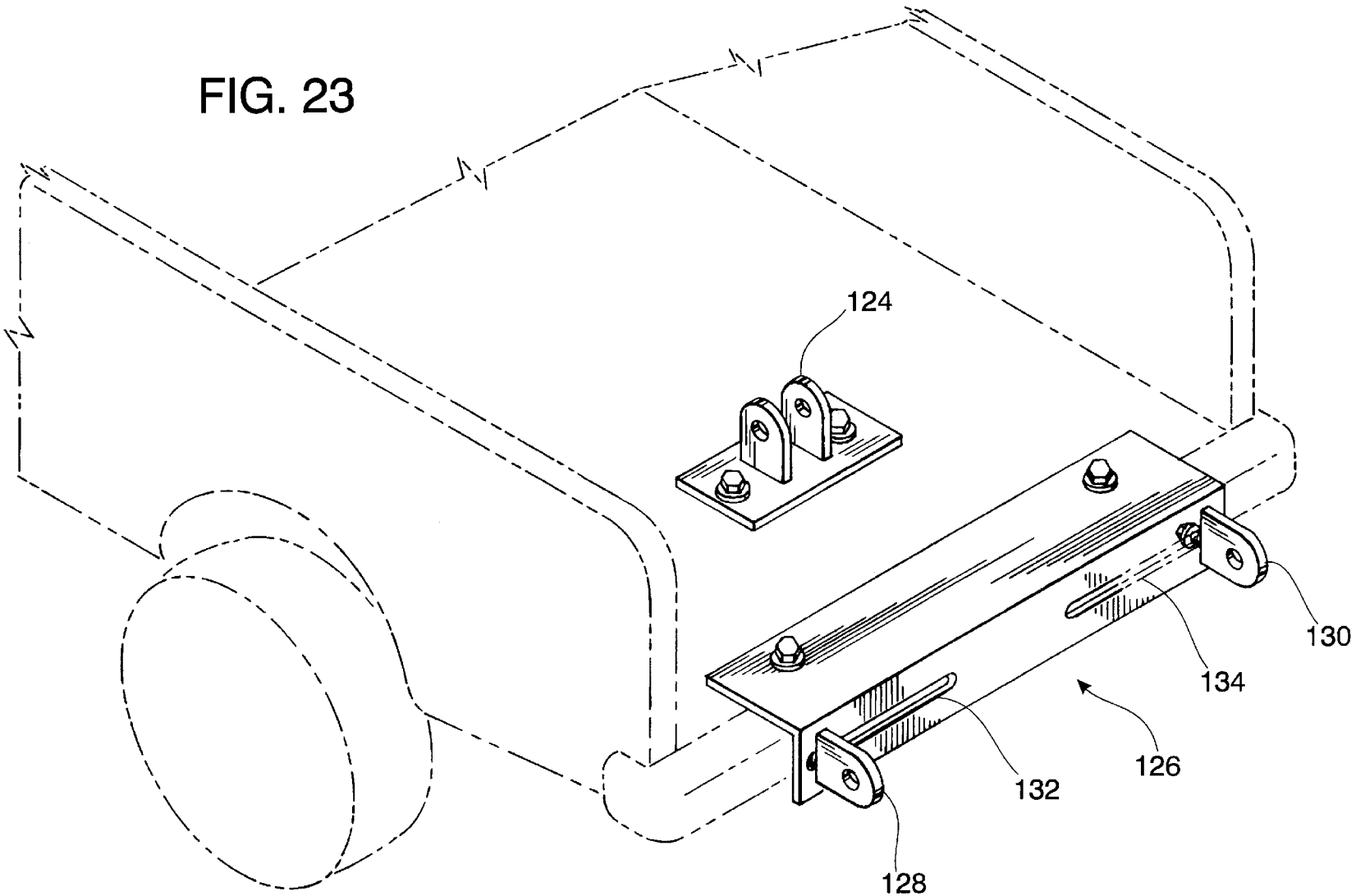
FIG. 23 is a perspective view of another embodiment of an attachment means for the devices of FIGS. 1–20.

Similarly, device 10, 49, 59, 84, or the like may be utilized with a pickup truck or other vehicle having a bed mounted bracket 124, as shown in FIG. 23, for receiving connecting arm 26 of device 10 as shown in FIG. 1. For use in conjunction with bed mounted bracket 124, a bumper mounted bracket 126 is provided to attach to the ends (116 and 120) of drawbar 20. Bumper mounted bracket 126 is provided with a left bracket 128 and a right bracket 130 slidably received in left slot 132 and right slot 134, respectively, to accommodate drawbars of different lengths and to allow for insertion of the drawbar.

Figure 24:
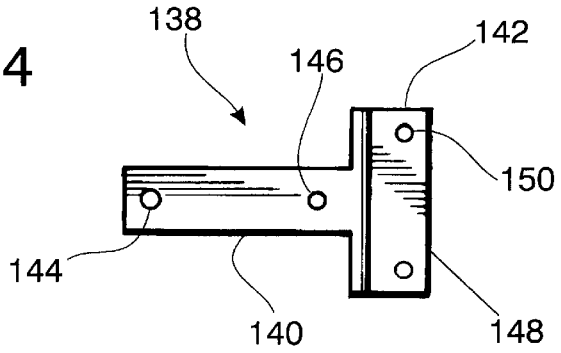
FIG. 24 is a top view representation of a drop down bracket attachment means for the device of FIG. 21.
Figure 25:
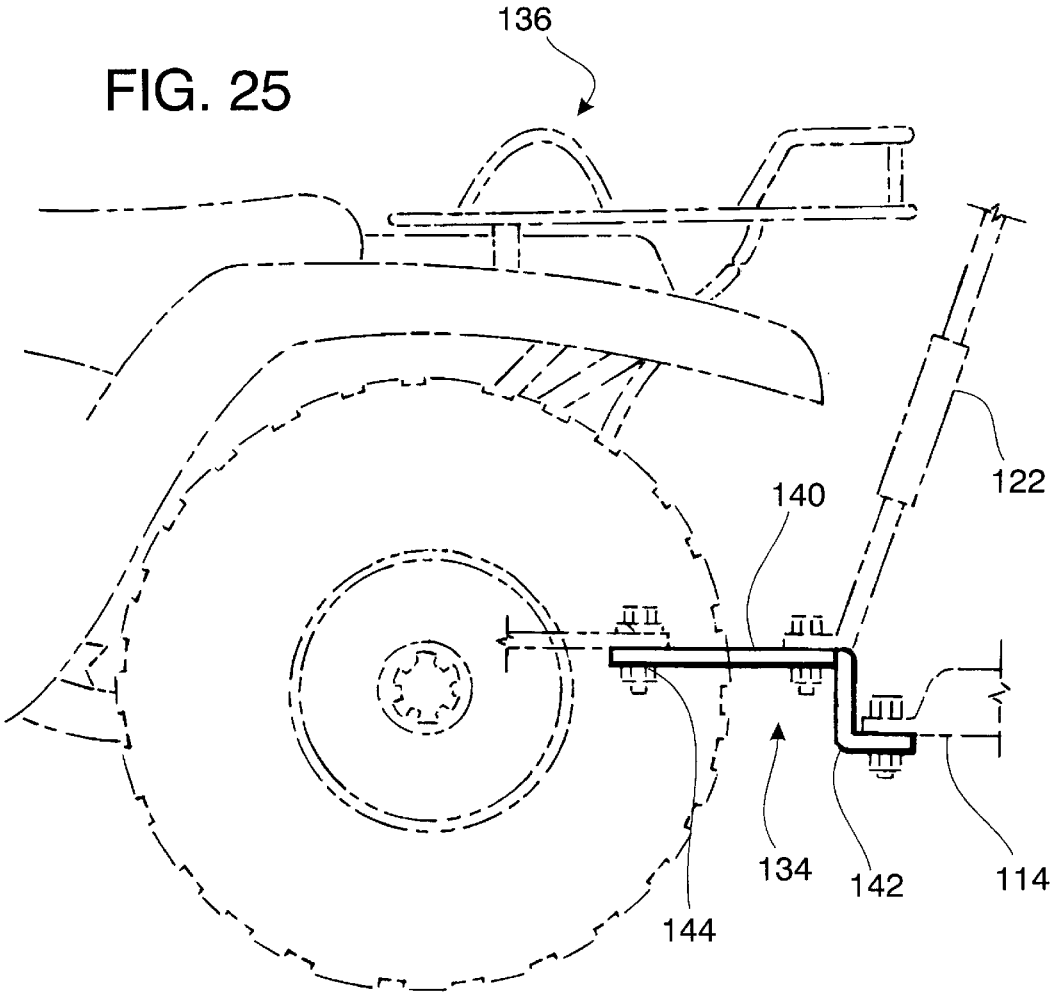
FIG. 25 is a side elevational view of the drop down bracket of FIG. 24 shown attached to a four-wheeler.

Further, device 10 may be attached to other types of vehicles, such as a four-wheeler 136, as shown in FIG. 25, by a drop-down bracket 138, as shown in FIGS. 24 and 25. Preferably, dropdown bracket 138 is formed to have a first narrow horizontal piece 140 and a lower second horizontal piece 142. Horizontal piece 140 is preferably provided with a first orifice 144 for attachment tc a tongue of the vehicle or four-wheeler 136 and a second orifice 146 for attachment to vertical connector 122 as shown in FIG. 25. Lower piece 142 is provided with left orifice 148 and right orifice 150 for attachment to device 10, preferably via first horizontal connector 114 and second horizontal connector 118.

If, for example, a wire fence having one or more rows of barbed wire positioned above the fence is desired, then spool 30 of fencing material is positioned on reeling and/or unreeling shaft 16 and one or more spools of individual wire are positioned above spool 30 with or without use of retainer plates 71. Retainer plates 71 may be affixed to shaft 16 at a desired height by positioning retainer plate 71 over shaft 16 and sliding retainer plate 71 down the length of shaft 16 until retainer clips 68 engage with slots 66. Depending upon the size of spool 30, a larger effective shaft diameter 94 may be desired. Larger effective diameter 94 is achieved by sliding one or more expander sleeves 96 and 98 over reeling shaft 16 and securing the expander sleeves 96 and 98 thereto or by replacing shaft 16 with a larger shaft.

Although FIGS. 1–5, 14 and 15 of the drawings show a manually operated winch 18 for raising and lowering the unreeling shafts 16, 80 and 82, it is contemplated that in accordance with the present invention a motor operated or motor driven winch arrangement may be used. For example, a hydraulically driven motor may be used to operate each of the winches 18. In accordance with one aspect of the present invention, it is possible for a single person to simply, easily, safely, and efficiently remove old fencing, replace fencing, or put in new fencing using one of the devices 10, 49, 59, 84, 86, or the like in combination with a tractor, truck, four-wheeler, or other motor vehicle without requiring the manual lifting of heavy rolls, reels, or spools of fencing material, wire, barbed wire, roll stock, or the like.

Whereas, the present invention has been described in relation to the drawings attached hereto, it should be understood that other and further modifications, apart from those shown or suggested herein, may be made within the spirit and scope of this invention.

What is claimed is:

1. A device for at least unreeling spools, reels, or rolls of fencing, wire, barbed wire, roll stock, or other wound ranching, agricultural or farming fencing material, and adapted for attachment to the rear of a tractor, pickup truck, or other vehicle comprising:

a horizontal frame assembly including a drawbar and a cantilever frame extending horizontally from said drawbar, said drawbar adapted for connection to a vehicle;

a vertical frame assembly affixed to at least said drawbar of said horizontal frame assembly and having a bracket extending transversely therefrom and adapted for connection to a vehicle;

a rotatable shaft pivotally attached to a free end of said cantilever frame, said shaft having a pivot end pivotally attached to said free end and a terminal end, said shaft also having a base above said pivot end for supporting a spool of fencing material thereon, said shaft adapted for receiving the spool of fencing material thereover; and a winch attached to an upper end of said vertical frame assembly and having a winch cable selectively attached to said terminal end of said shaft for lowering and raising said shaft to selectively orient said shaft in an upright or horizontal position.

2. The device recited in claim 1, wherein said winch cable has a hook at the free end thereof for releasably affixing the cable to an attachment loop at said terminal end of said shaft.

3. The device recited in claim 1, further comprising a first horizontal connector affixed to a first end of said drawbar, a second horizontal connector affixed to a second end of said drawbar, and a vertical connector affixed to said vertical frame bracket, said first horizontal connector, said second horizontal connector and said vertical connector being structured for affixing said device to a drop-hitch plate.

4. The device recited in claim 1, further comprising at least one retainer plate on said shaft for spacing one or more spools along said shaft.

5. The device recited in claim 4, wherein said shaft has a slot formed thereon for receiving a retainer clip positioned on said retainer plate for fixing said retainer plate in position on said shaft.

6. The device recited in claim 1, wherein said shaft is rotationally driven by a rotating means for assisting in at least one of reeling and unreeling spools of material.

7. The device recited in claim 6, wherein said rotating means is a hydraulically driven motor.

8. The device recited in claim 6, wherein said rotating means is a gear box driven by a power take-off shift.

9. The device recited in claim 1, further comprising at least one additional rotatable shaft for receiving an additional spool of material thereon.

10. The device recited in claim 1, further comprising a sleeve for increasing an effective outer diameter of said shaft, said sleeve having an inner diameter adapted to receive said shaft.

11. The device recited in claim 10, further comprising a securing means for rotationally affixing said sleeve to said shaft.

12. The device recited in claim 11, wherein said securing means is a bolt, said bolt passing through an orifice in said sleeve and engaging said shaft.

13. The device recited in claim 1 wherein said drawbar and said vertical frame bracket are structured to connect to a three-point hitch of a tractor.

14. A device for at least unreeling spools, reels, or rolls of fencing, wire, barbed wire, roll stock, or other wound ranching, agricultural or farming fencing material, and adapted for attachment to the rear of a tractor, pickup truck, or other vehicle comprising:

a horizontal frame assembly including a drawbar and a cantilever frame, said drawbar adapted for connection to a vehicle;

a vertical frame assembly affixed to said horizontal frame assembly and having a bracket adapted for connection to a vehicle;

a rotatable shaft pivotally attached to said cantilever frame, said shaft having a pivot end pivotally attached to said cantilever frame and a terminal end, said shaft also having a base above said pivot end for supporting a spool of fencing material thereon, said shaft adapted for receiving the spool of fencing material thereover;

a winch attached to said vertical frame assembly and having a winch cable selectively attached to said terminal end of said shaft for lowering and raising said shaft to selectively orient said shaft in an upright or horizontal position, wherein said winch cable has a hook at the free end thereof for releasably affixing the cable to an attachment loop at said terminal end of said shaft; and, a circular plate positioned proximate said terminal end of said shaft between said cable and the spool of material and dimensioned to prevent said cable from contacting the spool of material on said shaft.

15. A device for at least unreeling spools, reels, or rolls, of fencing, wire, barbed wire, roll stock, or other wound ranching, agricultural or farming fencing material, comprising:

a horizontal frame assembly including a drawbar and a cantilever frame extending horizontally from said drawbar, said drawbar adapted for connection to a vehicle;

a vertical frame assembly affixed to at least said drawbar of said horizontal frame assembly and having a bracket extending transversely therefrom and adapted for connection to a vehicle;

a rotatable shaft pivotally attached to a free end of said cantilever frame, said shaft having a pivot end pivotally attached to said free end and a terminal end, said shaft also having a base above said pivot end for supporting a spool of material thereon, said shaft adapted for receiving the spool of material thereover; and a hydraulic cylinder attached to said shaft for lowering and raising said shaft to selectively orient said shaft in an upright or horizontal position.

16. The device recited in claim 15, wherein said hydraulic cylinder is pivotally affixed at a first end to said horizontal frame assembly proximate said drawbar and pivotally affixed at a second end proximate said base on said shaft.

17. The device recited in claim 15, wherein said shaft is rotationally driven by a rotating means for assisting in at least one of reeling and unreeling spools of material.

18. The device recited in claim 17, wherein said rotating means is a hydraulically driven motor.

19. The device recited in claim 17, wherein said rotating means is a gear box driven by a power take-off shaft.

20. A device for reeling and unreeling spools, reels or rolls of fencing, wire, barbed wire, roll stock, or other wound fencing material, comprising:

a horizontal frame assembly including a drawbar and a cantilever frame extending horizontally from said drawbar, said drawbar adapted for connection to a vehicle;

a vertical frame assembly affixed to at least said drawbar of said horizontal frame assembly and having a bracket extending transversely therefrom and adapted for connection to a vehicle;

rotatably driven shaft pivotally attached to a free end of said cantilever frame, said shaft having a pivot end pivotally attached to said free end and a terminal end, said shaft also having a base above said pivot end for supporting a spool, reel, or roll of fencing, wire, barbed wire, or roll stock thereon, said shaft adapted for receiving the spool of material thereover; and means for selectively rotating said shaft to reel or unreel said fencing, wire, barbed wire, or roll stock.

21. A device for at least one of unreeling and reeling spools, reels, or rolls of fencing, wire, barbed wire, roll stock, or other wound agricultural, farming or ranching material, comprising:

a horizontal frame assembly including a drawbar and a cantilever frame extending horizontally from said drawbar, said drawbar adapted for connection to a vehicle;

a vertical frame assembly affixed to at least said drawbar of said horizontal frame assembly and having a bracket extending transversely therefrom and adapted for connection to a vehicle;

a rotatable shaft pivotally attached to a free end of said cantilever frame, said shaft having a pivot end pivotally attached to said free end and a terminal end, said shaft also having a base above said pivot end for supporting a spool of material thereon, said shaft adapted for receiving the spool of material thereover; and shaft pivoting means mounted on at least one of said horizontal and vertical frame assemblies and operatively attached to at least one of said terminal end and said base of said shaft for lowering and raising said shaft to selectively orient said shaft in an upright or horizontal position.

22. The device recited in claim 21, wherein said shaft pivoting means is a winch having a cable with a hook at the free end thereof for releasably affixing the cable to an attachment loop at said terminal end of said shaft.

23. The device recited in claim 22, further comprising a circular plate positioned proximate said terminal end of said shaft between said cable and the spool of material and dimensioned to prevent said cable from contacting the spool of material on said shaft.

24. The device recited in claim 21, wherein said shaft pivoting means is a hydraulic cylinder for lowering and raising said shaft to selectively orient said shaft in an upright or horizontal position.

25. The device recited in claim 24, wherein said hydraulic cylinder is pivotally affixed at a first end to said horizontal frame assembly proximate said drawbar and pivotally affixed at a second end proximate said base on said shaft.

26. The device recited in claim 21, wherein said shaft is rotationally driven by a rotating means for assisting in at least one of reeling and unreeling spools of material.

27. The device recited in claim wherein said rotating means is a gear box driven by a power take-off shaft.

28. The device recited in claim 26, wherein said rotating means is a hydraulically driven motor.

29. A device for at least unreeling spools, reels, or rolls of fencing, wire, barbed wire, roll stock, or other wound ranching, agricultural or farming fencing material, and adapted for attachment to the rear of a tractor, pickup truck, or other vehicle, comprising:

a horizontal frame assembly including a drawbar and a cantilever frame extending horizontally from said drawbar, said drawbar adapted for connection to a vehicle;

a vertical frame assembly affixed to at least said drawbar of said horizontal frame assembly and having a bracket extending transversely therefrom and adapted for connection to a vehicle;

a rotatable shaft pivotally attached to a free end of said cantilever frame, said shaft having a pivot end pivotally attached to said free said and a terminal end, said shaft also having a base above said pivot end for supporting a spool of fencing material thereon, said shaft adapted for receiving the spool of fencing material thereover;

a winch attached to an upper end of said vertical frame assembly and having a winch cable selectively attached to said terminal end of said shaft for lowering and raising said shaft to selectively orient said shaft in an upright or horizontal position; and, a circular plate positioned proximate said terminal end of said shaft between said cable and the spool of material and dimensioned to prevent said cable from contacting the spool of material on said shaft.

* * * * *